United States Patent [19]

Jodrey et al.

[11] Patent Number: 4,457,079

[45] Date of Patent: Jul. 3, 1984

[54] BOTTLE COOLER

[75] Inventors: Robert M. Jodrey, Westboro; Paul Croci, Southboro, both of Mass.

[73] Assignee: Dennison Manufacturing Company, Framingham, Mass.

[21] Appl. No.: 357,942

[22] Filed: Mar. 15, 1982

[51] Int. Cl.[3] ..... F26B 15/18

[52] U.S. Cl. ..... 34/105; 34/233

[58] Field of Search ..... 34/20, 104, 105, 21, 34/231, 225, 233

[56] References Cited

U.S. PATENT DOCUMENTS

| | | | |
|---|---|---|---|
| 2,599,721 | 6/1952 | Remington et al. | 34/105 |
| 2,644,188 | 7/1953 | Pacilio | 34/105 |
| 3,381,391 | 5/1968 | Yunghahn | 34/105 |
| 3,755,916 | 9/1973 | Gulaian | 34/105 |
| 3,946,501 | 3/1976 | Cotterell | 34/155 |

*Primary Examiner*—Larry I. Schwartz

*Attorney, Agent, or Firm*—Arthur B. Moore

[57] ABSTRACT

Apparatus for convectively cooling bottles and the like in a heat transfer decorator. Bottles travel on an underlying conveyor where they are subjected to descending air streams issuing from a plenum chamber. Refrigerated or room temperature air is directed from the plenum chamber by a series of fans, and routed through a honeycomb flow straightener which reduces the helical turbulence of the air streams. The air streams pass between nozzle plates which further enhance the flow uniformity.

8 Claims, 3 Drawing Figures

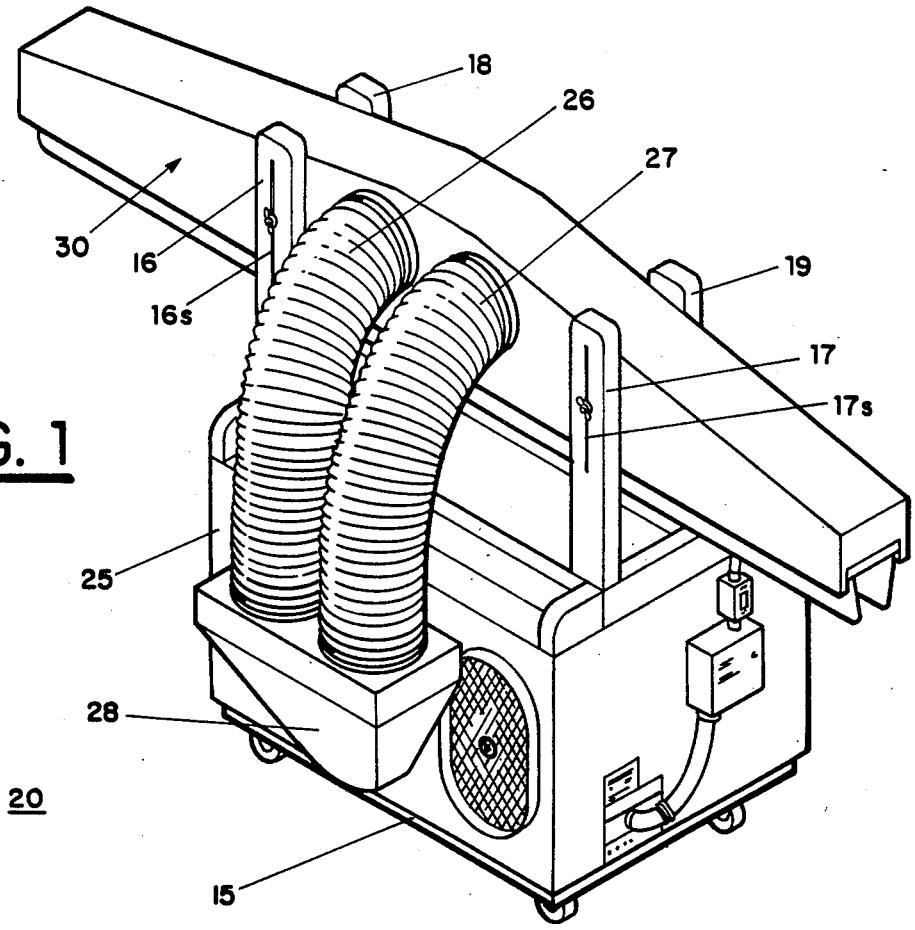
FIG. 1
FIG. 2
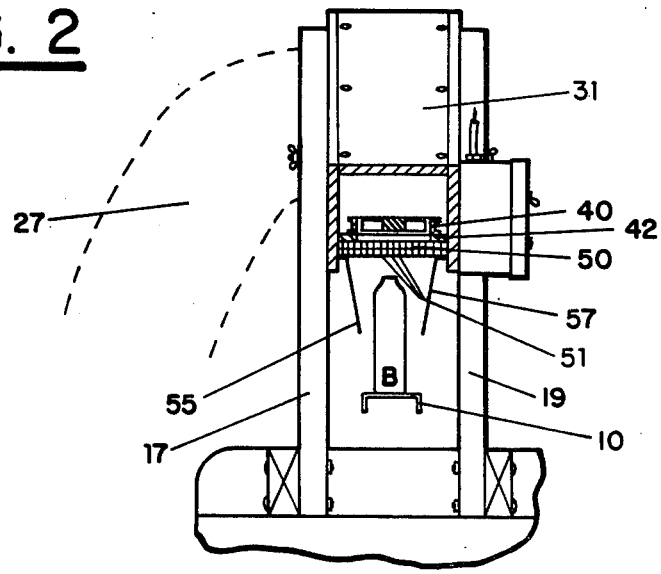

BOTTLE COOLER

BACKGROUND OF THE INVENTION

The present invention relates to heat transfer decorators, and more particularly to bottle cooling devices in heat transfer decorators.

One commonly employed decorating technique for bottles and the like involves pressing a heated label against an article to be labelled, typically a bottle of glass, plastic or other material. Typical U.S. patents illustrating this process include U.S. Pat. Nos. 3,064,714; 3,208,897; 3,231,448; 3,616,015; and 3,922,435. As noted in U.S. Pat. No. 3,616,015, it is often desirable in such decoration to increase the smoothness and gloss of the image after transfer by exposing it to a jet of hot gas or other heating means in order to remelt the transferred label. In order to achieve high production speeds, it is desirable to provide means for cooling the heated bottles to permit handling for further processing without damage to the transfer image. Such bottle cooling apparatus is preferably of an inexpensive construction, and should cool the bottles efficiently. It is particularly desirable to provide in-line bottle cooling apparatus which does not interrupt bottle transport.

SUMMARY OF THE INVENTION

In furthering the above and related objects, the apparatus of the invention cools bottles and like articles travelling on an underlying conveyor using downwardly directed air streams. Refrigerated or room temperature air is routed into a plenum chamber over the bottle conveyor, and directed by a series of flow control devices which achieve a uniform, descending air flow. The descending air stream flows past the inner and outer bottle surfaces, thereby convectively cooling the bottles.

In accordance with one aspect of the invention, air travels through input ducts to pressurize the plenum chamber. In the preferred embodiment, such air is precooled by an air conditioner; alternatively, room temperature air may be employed. The pressurized air is directed through an array of fans at the chamber floor, which provide descending air streams with a helical turbulence.

As another aspect of the invention, the helically turbulent air streams pass through a honeycomb flow straightener located below the fans. Advantageously, the honeycomb flow straightener comprises a lattice of cells of sufficient depth to significantly reduce the helical turbulence.

In accordance with a further aspect of the invention, the air streams emerging from the honeycomb flow straightener pass between nozzle plates, i.e. vertically converging walls. These walls compress and merge the air streams, resulting in increased flow uniformity along the axis of bottle advance.

BRIEF DESCRIPTION OF THE DRAWINGS

The above and additional aspects of the invention are further illustrated with reference to the detailed description which follows, taken in conjunction with the drawings in which:

FIG. 1 is a perspective assembly view of bottle cooling apparatus in accordance with the preferred embodiment;

FIG. 2 is a sectional elevation view of the plenum chamber and input duct, in the cooling apparatus of FIG. 1.

DETAILED DESCRIPTION

Figure 3:
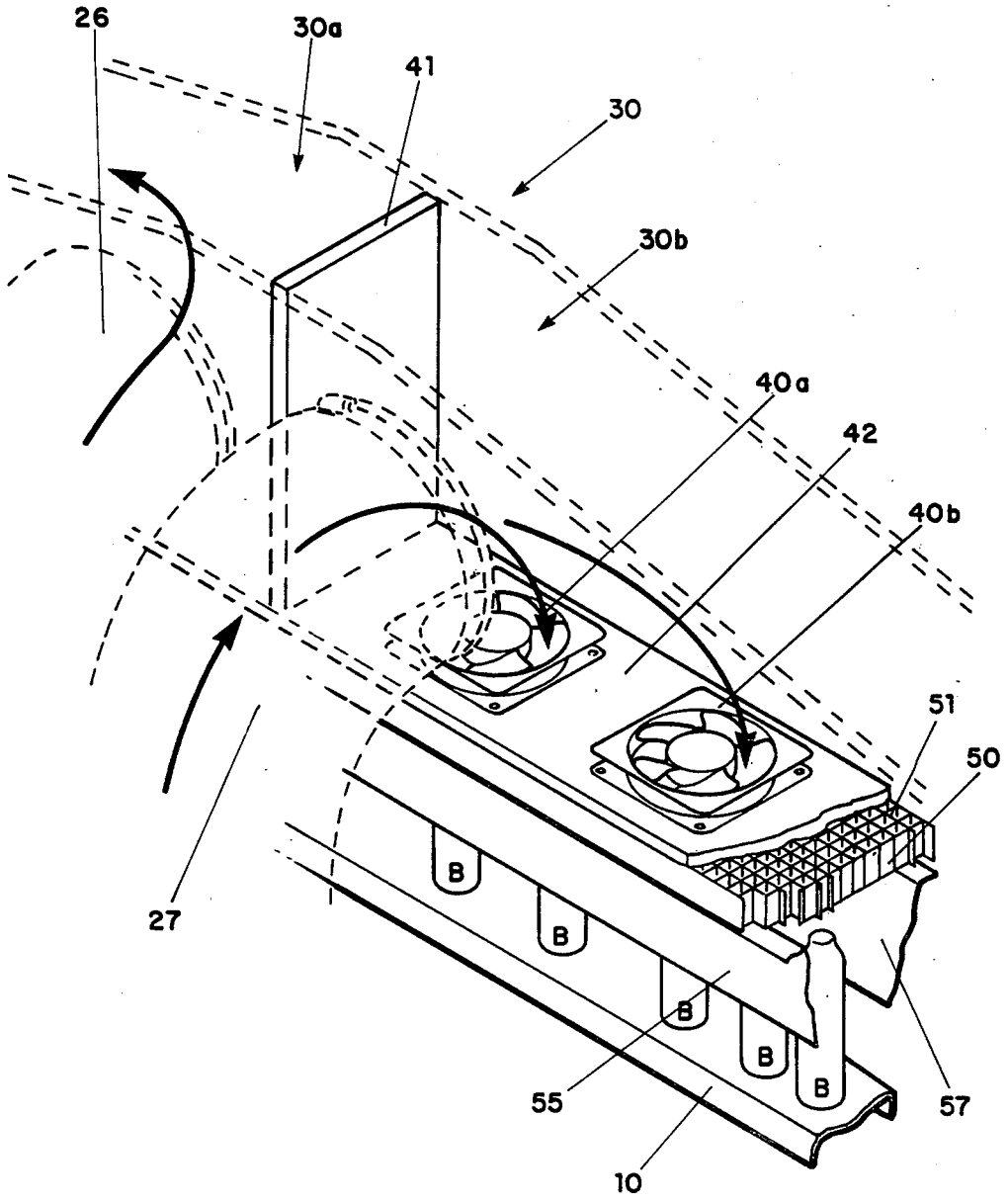
FIG. 3 is a cut-away perspective view of flow straightening devices for the bottle cooler of FIG. 1, shown in conjunction with a bottle-carrying conveyor.

Reference should now be had to FIGS. 1-3 for a detailed description of a preferred design for bottle cooling apparatus in accordance with the invention. FIG. 1 shows in perspective a bottle cooling assembly 20 of a type which is suitably employed in conjunction with heat transfer decorating apparatus as known in the prior art. The principal elements of bottle cooler 20 include plenum chamber 30 with air input ducts 26 and 27; air conditioner 25; and base 15. As illustrated, bottle cooler 20 comprises an easily moveable module which may be wheeled on base 15 into cooperation between a belt conveyor 10 and plenum chamber 30 (see FIG. 3). Plenum chamber 30 is mounted to base 15 on arms 16, 17, 18 and 19 having slots **16*s*** etc., thus allowing the user to adjust the vertical position of the chamber in accordance with the height of the bottles to be cooled; see FIGS. 2 and 3.

The bottle cooling apparatus 20 utilizes a convective cooling technique which involves pressurizing the plenum chamber 30, and directing descending air streams therefrom. By avoiding a significant horizontal component in these air streams, bottle cooler 20 cools bottles B without toppling them. In the preferred embodiment, the plenum chamber 30 is pressurized with refrigerated air provided by air conditioner 25, through elbow 28 and ducts 26 and 27. Ducts 26 and 27 illustratively comprise flexible hoses which are coupled to the wall of plenum chamber 30 using ferrules and hose clamps. In an alternative embodiment of the invention, bottle cooler 20 omits air conditioner 25 and pressurizes plenum chamber 30 using room temperature air.

With particular reference to FIG. 3, plenum chamber 30 is subdivided by a vertical wall 41 into chambers **30*a* and 30*b*, each receiving air from one of the ducts 26 and 27. Typically, the blower output of air conditioner 25 provides 1,000 cubic feet per minute of refrigerated air, and pressurizes the plenum chamber 30 at a few inches of water column pressure. The plenum chamber 30 is sealed above by roof 31 (FIG. 2), and at its base by a floor 42 on which a series of box fans 40*a*, 40*b***, etc. are mounted. Standard commercial box fans provide satisfactory performance in this apparatus.

With further reference to FIG. 3, box fans 40 (only two of which are shown) produce a series of descending high velocity air streams having helically turbulent flow; a typical figure for air velocity is 20 feet per second. Such air streams would be unsatisfactory for bottle cooling in that they would produce a torque on bottles B which would topple certain of these bottles. This helical turbulence is therefore mitigated in the discharge from the box fans 40 by using a honeycomb flow straightener 50. As shown in FIGS. 2 and 3, flow straightener 50 advantageously comprises a lattice of cells 51 of sufficient depth to absorb most of the transverse component of air streams descending from box fans 40. The depth of flow straightener 50 depends on the design of the box fans **40*a*, 40*b***, etc; a typical depth would be on the order of one inch.

Flow straightener 50 therefore produces a series of descending air streams characterized primarily by a vertical flow. These air streams then pass between nozzle plates 55, 57 i.e. vertically converging walls, which tend to compress and merge them. The resulting air flow is characterized by a substantial uniformity along the axis of bottle advance on conveyor 10.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims. Particular dimensions and air flow parameters are included herein only to describe a preferred embodiment of the invention.

We claim:

1. Apparatus for convectively cooling articles travelling on a moving conveyor, comprising:

a plenum chamber having a floor, means for supplying air to said plenum chamber to pressurize said chamber at above ambient pressure;

a plurality of fans located in the floor of said plenum chamber for directing air streams toward the conveyor;

a lattice of open cells located downstream of said fans and upstream of the conveyor, each of the cells having a passage with an axis in the direction of the conveyor so as to reduce turbulence of the air streams passing therethrough; and at least two plates located downstream of the lattice of open cells and straddling the articles travelling on the conveyor, said plates converging in the direction of said conveyor so as to direct said air streams uniformly over the articles.

2. Apparatus as defined in claim 1 further comprising means for refrigerating the air supplied to the plenum chamber.

3. Apparatus as defined in claim 1 of the type wherein the articles are transported on an underlying conveyor, wherein the plenum chamber is located vertically above the conveyor.

4. Apparatus as defined in claim 1 further comprising a base to which said plenum chamber is mounted to permit varying its separation from the conveyor.

5. Apparatus as defined in claim 1 wherein said base comprises a self-contained structure together with said plenum chamber, said lattice of cells, and said converging plates.

6. Apparatus as defined in claim 1, wherein said plates include a region of broadest separation immediately adjacent the lattice of cells.

7. Apparatus as defined in claim 1, wherein each of the cells comprise a prism having open faces at the prism bases.

8. Apparatus as defined in claim 7, wherein the lattice cells have right angles between the base edges and the side edges.

* * * * *